United States Patent [19]

McAlister

[11] Patent Number: 4,808,449

[45] Date of Patent: Feb. 28, 1989

[54] METHOD FOR APPLYING A DRIED COATING OF BIOLOGICALS TO THE INTERIOR OF A CONTAINER

[75] Inventor: Gary B. McAlister, Beacon Falls, Conn.

[73] Assignee: Sherwood Medical Company, St. Louis, Mo.

[21] Appl. No.: 900,193

[22] Filed: Aug. 25, 1986

[51] Int. Cl.[4] ..... B01L 3/02; B05D 7/22; B65D 23/02

[52] U.S. Cl. ..... 428/34.1; 128/765; 422/100; 427/2; 427/238; 428/144; 428/316.6; 428/34.6; 428/36.91

[58] Field of Search ..... 128/763, 765; 604/266; 422/100, 102; 427/2, 238; 428/35, 144, 316.6

[56] References Cited

U.S. PATENT DOCUMENTS

| | | | |
|---|---|---|---|
| 4,087,567 | 5/1978 | Sullivan | 427/2 |
| 4,501,719 | 2/1985 | Williams | 422/102 |
| 4,529,614 | 7/1985 | Burns | 427/2 |
| 4,595,021 | 6/1986 | Shimizu et al. | 128/765 |
| 4,657,028 | 4/1987 | Rich et al. | 128/763 |

*Primary Examiner*—Ellis P. Robinson
*Assistant Examiner*—James J. Seidleck
*Attorney, Agent, or Firm*—Stanley N. Garber; Andrew J. Beck; Montgomery W. Smith

[57] ABSTRACT

Containers such as syringes can be coated on their interior surface with biologicals such as heparin by atomizing the biological inside the container and reducing the pressure within the container for a period of time sufficient to allow the atomized biological to "auto-freeze" dry.

29 Claims, No Drawings

METHOD FOR APPLYING A DRIED COATING OF BIOLOGICALS TO THE INTERIOR OF A CONTAINER

BACKGROUND OF THE PRESENT INVENTION

The present invention relates to a method for providing a dried coating on the interior of a container. More particularly, the present invention relates to coating syringe interiors with biologicals such as anticoagulants that are used in blood analysis.

DESCRIPTION OF THE PRIOR ART

Heparin is an anticoagulant derived from porcine intestinal mucosa or beef lung. This anticoagulant is extremely valuable in preventing the coagulation of blood samples prior to blood gas analysis or other blood tests. The principal method for utilizing heparin in aspirating a blood sample has been by use of a syringe to draw a set volume of heparin solution from a vial. This usually involves drawing out more of the heparin than is needed and then expelling the excess. The blood sample is then taken in the normal manner.

An alternative method of supplying the heparin is to provide a throw-away syringe which contains a specific concentration of the heparin. U.S. Pat. No. 4,257,426 issued Mar. 24, 1981 to Bailey shows the inclusion of a heparin flake of pre-set unit dosage within the barrel of the syringe. The flake is formed by evaporating a solution of heparin containing the desired unit dosage.

In U.S. Pat. No. 4,521,975, unit dosages of heparin called pledgets or puff balls are formed by filling tiny wells of a plate with unit dosages of heparin solution and lyophilizing the heparin solution to provide the pledgets. This process requires the freezing of the interior of the freezer, the trays containing the unit dosages and all surrounding areas within the freezer. After freezing, the temperature is elevated slightly with application of vacuum to sublime off the water. The pledget is placed in the syringe and stored therein until it is necessary to aspirate a blood sample. In addition to the costs of lyophilization, the additional step of inserting the pledget into the syringe adds costs and time to the manufacturing process.

In order to overcome the disadvantages of separately preparing solid heparin and physically inserting the solid heparin into a syringe in a unit dosage, the prior art has ultrasonically atomized a heparin solution directly into the syringe barrel. The syringe barrels are then placed into drying ovens to dry the solution. Upon completion of the drying, the barrels are removed and final assembly of the syringe is completed. This provides a coating of beads of heparin on the syringe wall which presents more surface area for faster dissolution than the heparin flake. While this process overcomes the problem of separately drying the heparin and adding it to the syringe barrel, the process requires the use of an excessive amount of energy which could be to the disadvantage of throw-away plastic syringe barrels.

BRIEF DESCRIPTION OF THE INVENTION

In accordance with the present invention, the interior surface of containers can be easily coated with less energy requirements while providing porous coatings having a larger total surface area for ease of dissolution. Containers such as syringes can be interiorly coated with biologicals, such as anticoagulants, by atomizing the biological, such as heparin, inside the container to coat the container surface with droplets of a size larger than that which will dry at ambient temperature shortly after application and small enough to permit rapid freezing and reducing the pressure within the container for a period of time sufficient to allow the droplets to dry. By this process, porous beads of uniform and controllable dosages of biologicals are formed on the surface of the container in less time, without the cost, time and energy required for conventional freeze drying, and without the need for an additional step of physically placing a pledget of biological in the container.

DETAILED DESCRIPTION OF THE INVENTION

The process of the invention can be used to coat the interior of containers with biologicals. The invention finds particular utility in coating the interior of syringe barrels such as those used in arterial blood gas analysis. The invention can also be used to coat the interior of reduced pressure blood containers which, in combination with a syringe needle device, rely on the differential in pressure to effect drawing of a blood sample. Other containers such as stoppered vials can also be coated in accordance with the process of the invention. For discussion the following description will be directed to syringe barrels though the process details are applicable to any container.

The syringe barrel can be coated with various biologicals such as anticoagulants which can be illustrated by EDTA, citrates and heparin, the latter being the only anticoagulant recommended for arterial blood gas syringes. The remaining discussion will be directed to heparin through the disclosure is equally applicable to other biologicals.

A solution of heparin in a solvent such as water is atomized into the syringe barrel to form a coating of fluid droplets of a size larger than that which will dry at ambient temperature and small enough to permit rapid freezing. The particle size of the droplets preferably ranges from about 400 microns to about 2000 microns. A preferred means of atomization is ultrasonic atomization though other means such as air pressure atomization can be used. Ultrasonic atomization is preferred since it provides a coating of particles within the desired range. If the particles are too large, the particles cannot be dried by application of vacuum, and if too small, the particles dry before establishing a coating and do not form porous beads. The barrels can be singly coated or trays of barrels can be coated. In the preferred embodiment, the ultrasonic atomizer enters the barrel to provide a coating on a limited area. Since plungers in arterial blood gas syringes are usually set for a specific volume, there is no need to coat the area above the plunger. Because the anticoagulant is part of the blood sample, it is desirable that the heparin be provided within the syringe in specified unit dosages. For arterial blood gas analysis, dosages ranging from about 30 to about 100 USP (United States Pharmacopeia) units per cubic centimeter of blood are suggested. These amounts can be corrected for any potential loss of heparin in the vacuum drying. These losses can be on the order of 1–3% and are considered negligible.

The pressure within the syringe barrel is then reduced to a point sufficient to cause evaporation of the solvent for the biological, but insufficient to cause large losses of the biological (more than about 5%) Conveniently, trays of barrels can be placed in a vacuum chamber and a vacuum ranging from about 0.005 to about 0.10 mm Hg (about 0.667 to about 13.33 pascals) can be applied. If the particles are of the proper size, the vacuum causes an "auto-freezing" effect which freezes the droplets. Continued application of the vacuum causes the ice to sublime, leaving porous beads of heparin on the interior surface of the syringe barrel. The heparin in the syringe barrel does not have to be prefrozen as in conventional lyophilization. It is only desirable to heat the syringe barrel after drying above ambient temperature to prevent condensation. A convenient vacuum chamber is a freeze drier where only the vacuum need to be drawn through a condenser.

The coating method of the invention is sufficiently efficient that less time is required for treatment. Typically, syringe barrels can be treated and prepared for assembly in accordance with the invention in ½ hour, vis-a-vis the 2–5 hours generally required in preparing the heparin pledgets and adding them to syringes and is equivalent to the ½ hour used in atomizing heparin into syringe barrels and drying under heated conditions (115° C.).

The process of the invention provides various advantages over conventional atomized and dried heparin resulting from the fact that the solid particles of heparin are locked into a lattice-work matrix. The shelf life of the heparin is extended because the particles of the material cannot interact with each other. Also, the matrix structure provides a large surface area which greatly increases the rate of redissolution of the heparin upon contact with blood or water.

While the present invention has been described with some degree of particularity, it is understood that the present disclosure has been made by way of example and that changes in the details of the process can be made without departing from the spirit thereof.

EXAMPLE 0.025 milliliters of a lithium heparin solution (1.8 USP units/microliter) were atomized into each of various syringe barrels of 0.9525 centimeter diameter at a level up to the 2 cubic centimeters volume mark of the syringe using a Sonotek Ultrasonic Atomizing Nozzle having an interior diameter of 0.102 centimeter (0.040 inches) to obtain droplets ranging from approximately 0.0127 to approximately 1.9 millimeters in diameter. The heparinized syringe barrels were placed in a Virtis 600 SL Laboratory Freeze Dryer at room temperature (22° C.). The unit is equipped with a condenser which was maintained at approximately −60° C.. The chamber pressure of the freeze dryer was reduced to approximately 10.67 pascals (80 millitorr or $80\times10^{-3}$ mm Hg) in approximately 25 minutes. The vacuum was maintained for 25–30 minutes. The vacuum was relieved and the syringe barrels were removed from the chamber.

The resultant heparin coating is superior to the same coating oven dried as evidenced by an increased rate of dissolution of the heparin coating. The above example required 50–55 minutes to complete the entire cycle. Cycle times can be reduced significantly depending on equipment design.

What is claimed is:

1. A medical container having an inner surface and a coating of porous particles on said inner surface, said porous particles being formed by atomizing a solution of said anticoagulant in a solvent to coat a layer of droplets of the solution on said inner surface and reducing the pressure on said inner surface sufficient to cause rapid evaporatioon of said solvent, said droplets being large enough not to dry before pressure reduction and small enough to cause rapid evaporation of said solvent under the reduced pressure.

2. The medical container of claim 1 wherein the container is a syringe barrel.

3. The medical container of claim 1 wherein said porous particles have a size between about 400 microns and about 2000 microns.

4. The medical container of claim 1 wherein the anticoagulant is heparin.

5. The medical container of claim 1 wherein the porous particles of said coating are locked into a lattice-work matrix on said inner surface as a result of said pressure reduction and rapid evaporation.

6. A syringe barrel having an interior, an interior surface, and a layer of porous particles of an anticoagulant on said interior surface, said particles being formed by atomizing a solution of said anticoagulant in a solvent to coat a layer of droplets on said interior surface and reducing the pressure within said interior sufficient to cause rapid evaporation of said solvent, said droplets being large enough not to dry before pressure reduction and small enought to allow rapid evaporation of said solvent under the reduced pressure.

7. A process for coating an interior surface of a medical container comprising atomizing a solution of an anticoagulant in a solvent therefor so as to form a layer of distinct droplets on said interior surface, and reducing the pressure within the container to a point sufficient to cause rapid evaporation of the solvent from the droplets, the evaporation being sufficient to cause freezing of the droplets, sublimation of the solvent and formation of a coating of porous particles.

8. The process of claim 1 wherein the anticoagulant is heparin.

9. The process of claim 1 wherein the droplets are formed by ultrasonic atomization.

10. The process of claim 1 wherein the anticoagulant is EDTA.

11. The process of claim 1 wherein the anticoagulant is a citrate .

12. A process for coating an interior surface of a syringe barrel with an anticoagulant comprising atomizing a solution of the anticoagulant and a solvent in the syringe barrel to form a layer of droplets of the anticoagulant solution on said interior surface of the syringe barrel, and reducing the pressure within the syringe barrel sufficient to allow for rapid evaporation of said solvent and formation of porous particles, said droplets being large enough not to dry before pressure reduction and small enough to allow rapid evaporation of the solvent under the reduced pressure.

13. The process of claim 12 wherein the syringe is an arterial blood gas analysis syringe.

14. The process of claim 13 wherein the anticoagulant is heparin.

15. The process of claim 12 wherein the anticoagulant is heparin.

16. The process of claim 12 wherein the pressure is reduced to a vacuum within the range of from about 0.667 to about 13.33 pascals.

17. The process of claim 12 wherein the droplets are formed by ultrasonic atomization.

18. A process for coating an inner surface of a medical container with an anticoagulant comprising atomizing a solution of the anticoagulant and solvent in the container to form a layer of droplets of the solution on the inner surface and reducing the pressure on the inner surface sufficiently to cause rapid evaporation of the solvent from the droplets and formation of a coating of porous particles, said droplets being large enough not to dry before said pressure reduction and small enough to allow rapid evaporation of the solvent under the reduced pressure.

19. The process of claim 18 wherein said evaporation is sufficient to cause freezing of the droplets, sublimation of the solvent and formation of the coating of porous particles.

20. The process of claim 18 wherein said solution is atomized to produce droplets on said inner surface having a size between about 400 microns and about 2000 microns.

21. The process of claim 18 wherein the anticoagulant is heparin.

22. The process of claim 18 wherein the pressure is reduced to a vacuum within the range of from about 0.667 to about 13.33 pascals.

23. The process of claim 18 wherein the droplets are formed by ultrasonic atomization.

24. The process of claim 18 wherein the container is a syringe barrel.

25. The process of claim 18 wherein the container is a syringe barrel of an arterial blood gas analysis syringe.

26. The process of claim 18 wherein said porous particles of said coating are locked in a lattice-work matrix on said inner surface.

27. The process of claim 18 wherein the anticoagulant is EDTA.

28. The process of claim 18 wherein the anticoagulant is a citrate.

29. The process of claim 18 wherein said evaporation is sufficient to cause freezing of the droplets, sublimation of the solvent and formation of porous particles of said biological locked in a lattice-work matrix coating on said container surface.

* * * * *